US008948623B2

(12) United States Patent
Suzuki et al.

(10) Patent No.: US 8,948,623 B2
(45) Date of Patent: Feb. 3, 2015

(54) DEVELOPING DEVICE AND IMAGE FORMING APPARATUS

(71) Applicant: Fuji Xerox Co., Ltd., Tokyo (JP)

(72) Inventors: Shiro Suzuki, Kanagawa (JP); Akihiko Noda, Kanagawa (JP); Tatsuo Okuno, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 147 days.

(21) Appl. No.: 13/679,394

(22) Filed: Nov. 16, 2012

(65) Prior Publication Data

US 2013/0315611 A1 Nov. 28, 2013

(30) Foreign Application Priority Data

May 22, 2012 (JP) ..... 2012-116363

(51) Int. Cl.
*G03G 15/08* (2006.01)

(52) U.S. Cl.
CPC ..... *G03G 15/0832* (2013.01); *G03G 15/0877* (2013.01)
USPC ..... 399/30

(58) Field of Classification Search
USPC ..... 399/27, 30
See application file for complete search history.

(56) References Cited

U.S. PATENT DOCUMENTS

| | | | | |
|---|---|---|---|---|
| 6,640,060 | B2 * | 10/2003 | Yamaguchi et al. | 399/27 |
| 2009/0142079 | A1 * | 6/2009 | Sato et al. | 399/27 |
| 2012/0093527 | A1 * | 4/2012 | Itagaki et al. | 399/27 |

FOREIGN PATENT DOCUMENTS

| | | |
|---|---|---|
| JP | A-8-87165 | 4/1996 |
| JP | B2-3439537 | 8/2003 |

* cited by examiner

*Primary Examiner* — Walter L Lindsay, Jr.
*Assistant Examiner* — Rodney Bonnette
(74) *Attorney, Agent, or Firm* — Oliff PLC

(57) ABSTRACT

A developing device includes a developer holding member that holds a developer on a surface thereof to transport the developer to a developing region in which a latent image is developed as a visible image, an accommodating section that accommodates the developer supplied to the developer holding member, a supply section that is connected to the accommodating section and disposed above the developer holding member in the direction of gravity to supply the developer to the developer holding member from above, and a first transport member that is disposed in the supply section to transport the developer, and transports a predetermined or greater amount of a developer in the developer accommodated in the supply section to the outside of a region corresponding to the developer holding member.

8 Claims, 4 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2012-116363 filed May 22, 2012.

BACKGROUND

Technical Field

The present invention relates to a developing device and an image forming apparatus.

SUMMARY

According to an aspect of the invention, there is provided a developing device including a developer holding member that holds a developer on a surface thereof to transport the developer to a developing region in which a latent image is developed as a visible image; an accommodating section that accommodates the developer supplied to the developer holding member; a supply section that is connected to the accommodating section and disposed above the developer holding member in the direction of gravity to supply the developer to the developer holding member from above; and a first transport member that is disposed in the supply section to transport the developer, and transports a predetermined or greater amount of a developer in the developer accommodated in the supply section to the outside of a region corresponding to the developer holding member.

BRIEF DESCRIPTION OF THE DRAWINGS

Exemplary embodiments of the present invention will be described in detail based on the following figures, wherein.

DETAILED DESCRIPTION

Next, although specific examples of exemplary embodiments of the invention will be described with reference to the figures, the invention is not limited to the following exemplary embodiments.

For easy understanding of the following description, in the figures, the forward-backward direction is denoted by the X-axis direction, the leftward-rightward direction is denoted by the Y-axis direction, and the upward-downward direction is denoted by the Z-axis direction. In addition, the directions or sides represented by arrows X, −X, Y, −Y, Z, and −Z are assumed to be the forward direction, the backward direction, the rightward direction, the leftward direction, the upward direction, and the downward direction or the front side, the rear side, the right side, the left side, the upper side, and the lower side.

In addition, in the figures, "O" with "•" being drawn therein represents an arrow toward the front side from the rear side of the sheet, and "O" with "x" being drawn therein represents an arrow toward the rear side from the front side of the sheet.

In a description with reference to the following figures, for easy understanding thereof, members other than necessary members for the description will be omitted appropriately.

Exemplary Embodiment 1

Figure 1:
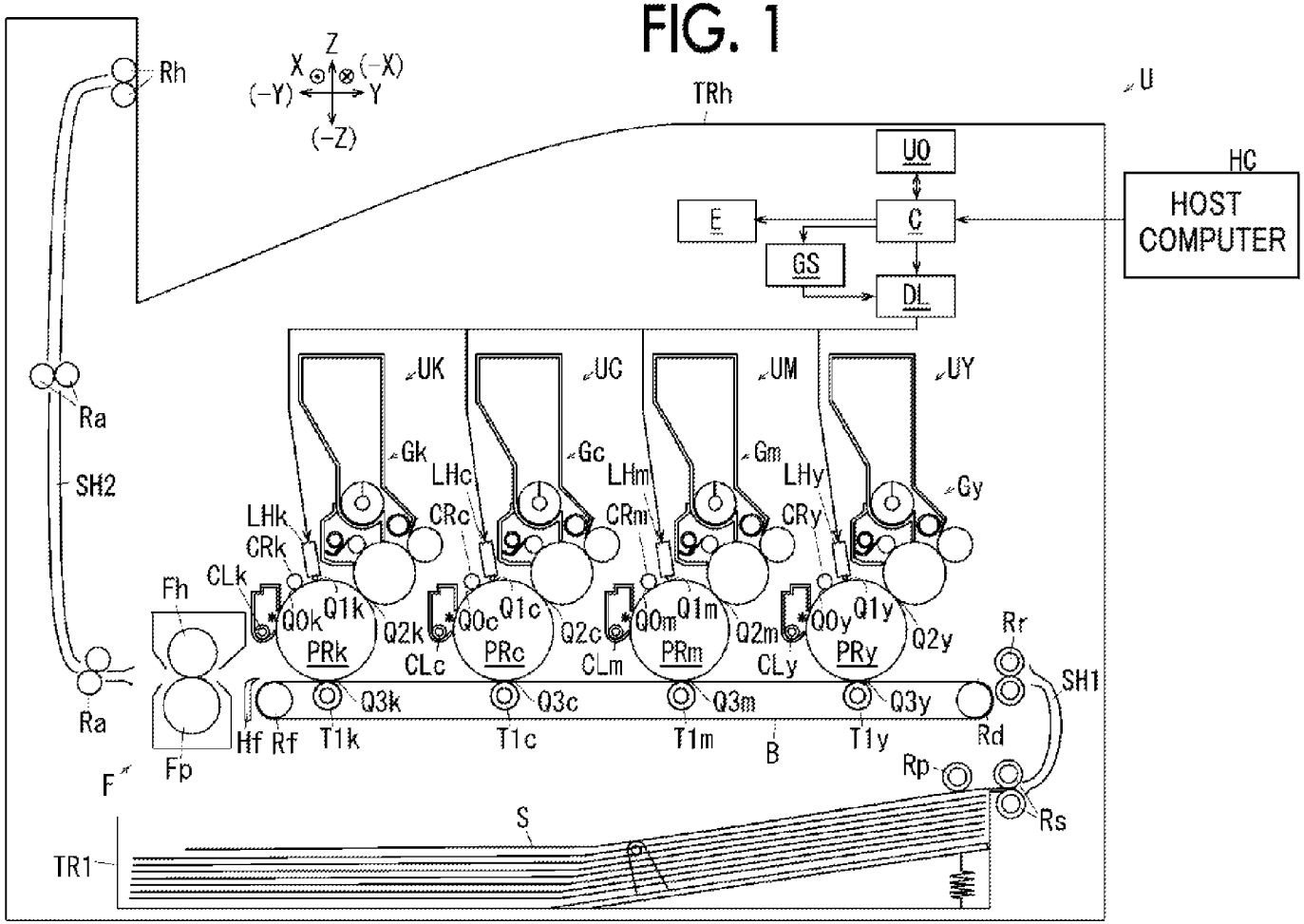
FIG. 1 is a diagram illustrating an image forming apparatus of Exemplary Embodiment 1 of the invention.

FIG. 1 is a diagram illustrating an image forming apparatus of Exemplary Embodiment 1 of the invention.

In FIG. 1, a printer U as an example of the image forming apparatus of Exemplary Embodiment 1 is provided with a paper output tray TRh as an example of a medium output section, on an upper surface thereof. A paper feeding tray TR1 as an example of a medium accommodating section is supported in a lower part of the printer U. The paper feeding tray TR1 accommodates recording sheets S as an example of a medium on which an image is recorded. In addition, a user interface U0 as an example of an input section is supported in an upper part of the printer U. With the user interface U0, an operator performs an input operation to be able to operate the printer U.

The printer U has a controller C as an example of a control section, a laser driving circuit DL as an example of a writing driving circuit which is controlled by the controller C, an image processing section GS, a power circuit E, and the like.

The image processing section GS converts image information input from a host computer HC or the like as an example of an exterior information processing device into image information for writing of four colors of Y: yellow, M: magenta, C: cyan, and K: black, temporarily stores the image information, and outputs the image information as image information for forming a latent image to a writing circuit DL at a predetermined time.

The host computer HC as an example of an image information transmitting device is electrically connected to the printer U. The printer U has the controller C as an example of a control section. The controller C is electrically connected to the user interface U0, the power circuit E, the image processing section GS, the writing circuit DL, the host computer HC, and the like. The controller C performs information transmission and reception with the user interface U0 and the like to perform various control operations.

The image processing section GS is electrically connected to the writing circuit DL. The image processing section GS converts image information input from the host computer HC or the like into image information for writing of four colors of Y: yellow, M: magenta, C: cyan, and K: black, and temporarily stores the image information. The image processing section GS outputs the image information to the writing circuit DL at a predetermined time.

The writing circuit DL is electrically connected to LED heads LHy, LHm, LHc, and LHk of colors of Y, M, C, and K as an example of a latent image forming device. The writing circuit DL outputs control signals to the LED heads LHy, LHm, LHc, and LHk of colors of Y, M, C, and K in accordance with input image information.

The LED heads LHy to LHk of Exemplary Embodiment 1 have a configuration in which laser diodes as an example of a light-emitting element are arranged in a line in the width direction of a recording sheet S, that is, have a so-called LED print head: LPH. The LED heads LHy to LHk emit laser beams as an example of light for writing in accordance with a control signal.

Photoreceptor drums PRy, PRm, PRc, and PRk as an example of an image holding member are arranged below the LED heads LHy to LHk, respectively. The photoreceptor drums PRy to PRk are rotated in the direction of the arrow Ya.

Charging rolls CRy, CRm, CRc, and CRk as an example of a charging unit are disposed to be opposed to the photoreceptor drums PRy to PRk in charging regions Q0*y*, Q0*m*, Q0*c*, and Q0*k*.

A charging voltage is applied to the charging rolls CRy to CRk from the power circuit E.

In writing regions Q1*y*, Q1*m*, Q1*c*, and Q1*k* set on the downstream side of the charging regions Q0*y* to Q0*k* in the rotation direction of the photoreceptor drums PRy to PRk, the LED heads LHy to LHk irradiate the surfaces of the photoreceptor drums PRy to PRk with laser beams as an example of writing light.

In developing regions Q2*y*, Q2*m*, Q2*c*, and Q2*k* set on the downstream side of the writing regions Q1*y* to Q1*k* in the rotation direction of the photoreceptor drums PRy to PRk, developing devices Gy, Gm, Gc, and Gk are disposed to be opposed to the surfaces of the photoreceptor drums PRy to PRk.

Transfer regions Q3*y*, Q3*m*, Q3*c*, and Q3*k* are set on the downstream side of the developing regions Q2*y* to Q2*k* in the rotation direction of the photoreceptor drums PRy to PRk.

An endless transfer belt B as an example of a medium transport member is disposed below the photoreceptor drums PRy to PRk. The transfer belt B is stretched between a driving roll Rd as an example of a driving member and a driven roll Rf as an example of a driven member. The surface of the transfer belt B sequentially passes through the transfer regions Q3*y* to Q3*k* opposed to the photoreceptor drums PRy to PRk of colors of Y, M, C, and K with the driving of the driving roll Rd.

Transfer rolls T1*y*, T1*m*, T1*c*, and T1*k* as an example of a transfer device are disposed on the rear surface of the transfer belt B in the transfer regions Q3*y* to Q3*k*. A transfer voltage is applied to the transfer rolls T1*y* to T1*k* from the power circuit E.

Drum cleaners CLy, CLm, CLc, and CLk as an example of a cleaning unit for the image holding member are disposed to be opposed to the surfaces of the photoreceptor drums PRy to PRk on the downstream side of the transfer regions Q3*y* to Q3*k* in the rotation direction of the photoreceptor drums PRy to PRk.

A pickup roll Rp as an example of a medium taking-out member is disposed in the upper right part of the lower paper feeding tray TR1 of the printer U. Handling rolls Rs as an example of a handling member are disposed on the right side of the pickup roll Rp.

A medium transport path SH1 extending upward is formed on the right side of the paper feeding tray TR1. In the transport path SH1, register rolls Rr as an example of a sending member are disposed on the upstream side of the transfer region Q3*y* in the transport direction of a sheet S. The register rolls Rr send a sheet S toward the transfer belt B at a predetermined time.

A peeling pawl Hf as an example of a medium peeling member is disposed on the downstream side of the transfer belt B in the transport direction of a sheet S. The peeling pawl Hf peels off a sheet S held on the surface of the transfer belt B.

A fixing device F is disposed on the left side of the peeling pawl Hf. The fixing device F has a heating roll Fh as an example of a rotation member for heating and a pressing roll Fp as an example of a rotation member for pressing.

A discharge path SH2 as an example of a medium transport path extending upward is connected to the fixing device F on the left side.

Transport rolls Ra as an example of a medium transport member which transport a sheet S and discharge rolls Rh are disposed in the discharge path SH2.

Description of Image Forming Operation

Image information transmitted from the host computer HC is transmitted to the image processing section GS. The image processing section GS converts the received image information into a digital image signal and outputs the image signal to the writing circuit DL. The writing circuit DL outputs a control signal according to an input image writing signal to the LED heads LHy to LHk.

The surfaces of the photoreceptor drums PRy to PRk are charged by the charging rolls CRy to CRk in the charging regions Q0*y* to Q0*k*. Laser beams output from the LED heads LHy to LHk form an electrostatic latent image on the surfaces of the photoreceptor drums PRy to PRk in the writing regions Q1*y* to Q1*k*. The developing devices Gy to Gk develops the electrostatic latent images on the photoreceptor drums PRy to PRk passing through the developing regions Q2*y* to Q2*k* as toner images as an example of a visible image in the developing regions Q2*y* to Q2*k*.

Sheets S in the paper feeding tray TR1 are taken out by the pickup roll Rp at a predetermined paper feeding time. When plural sheets S are taken out by the pickup roll Rp while overlapping each other, these are separated one by one by the handling rolls Rs. The sheets S passing through the handling rolls Rs are transported to the register rolls Rr.

The sheets S transported to the register rolls Rr are transported toward the transfer belt B in accordance with a time at which the toner images on the surfaces of the photoreceptor drums PRy to PRk are moved to the transfer regions Q3*y* to Q3*k*.

The sheets S transported from the register rolls Rr are supported on the surface of the transfer belt B and pass through the transfer regions Q3*y* to Q3*k*. The toner images on the surfaces of the photoreceptor drums PRy to PRk are transferred onto the sheets S passing through the transfer regions Q3*y* to Q3*k* with the transfer voltage applied to the transfer rolls T1*y* to T1*k*. In the case of monochrome printing, only K-color images are transferred from the photoreceptor drum PRk.

The surfaces of the photoreceptor drums PRy to PRk after passing through the transfer regions Q3*y* to Q3*k* are cleaned by removing the remaining toner using the drum cleaners CLy to CLk. The surfaces of the photoreceptor drums PRy to PRk after cleaning are re-charged by the charging rolls CRy to CRk.

The sheets S onto which the toner images are transferred are peeled off from the transfer belt B by the peeling pawl Hf. Regarding the sheets S peeled off from the transfer belt B, the toner images are heated and pressed to be fixed when passing through a contact region between the heating roll Fh and the pressing roll Fp.

The recording sheets S to which the toner images are fixed are transported to the discharge path SH2 and discharged to the paper output tray TRh by the discharge rolls Rh.

Description of Developing Device

Figure 2:
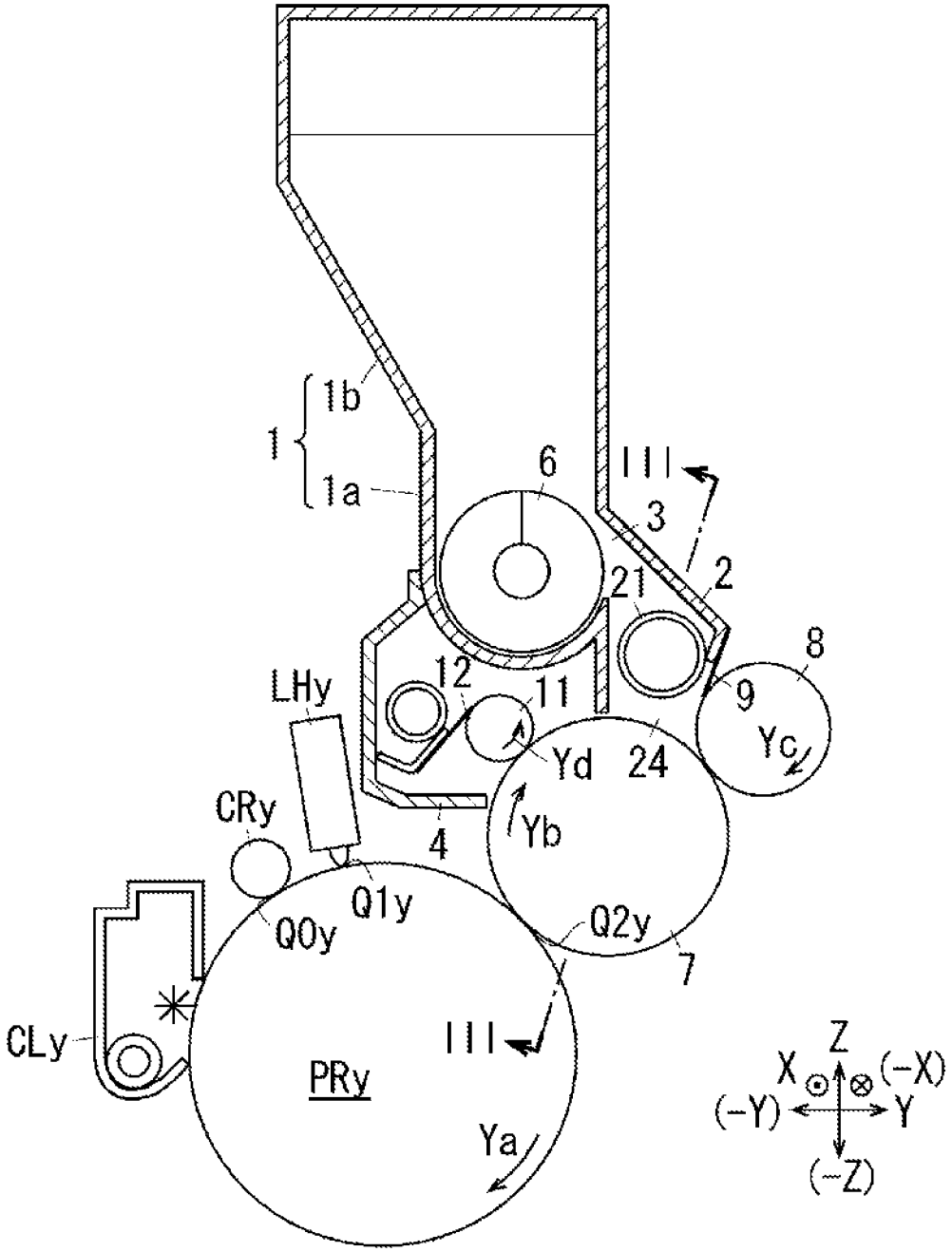
FIG. 2 is a diagram illustrating a developing device of Exemplary Embodiment 1.

FIG. 2 is a diagram illustrating the developing device of Exemplary Embodiment 1.

Next, the developing devices Gy to Gk will be described. However, since the developing devices Gy to Gk for Y, M, C, and K have the same configuration, only the developing device Gy for a Y color will be described in detail. Detailed description of other developing devices Gm, Gc, and Gk will be omitted.

In FIG. 2, the developing device Gy of Exemplary Embodiment 1 has a toner hopper 1 as an example of an accommodating section. A developer accommodating space extending in the forward-backward direction is formed in the toner hopper 1. A nonmagnetic single-component toner as an example of the developer is accommodated in the toner hopper 1 of Exemplary Embodiment 1. The toner hopper 1 of Exemplary Embodiment 1 has a lower part 1*a* having a narrow width in the leftward-rightward direction, and an upper part 1*b* which increases in width in the leftward-rightward direction toward the upper part. The upper part 1*b* of Exemplary Embodiment 1 extends leftward with respect to the lower part 1*a*. Accordingly, the toner hopper 1 is disposed so that the upper part 1*b* overlaps the upper part of the photoreceptor drum PRy.

In addition, a supply section 2 extending downward is supported on the right side of the lower part 1*a* of the toner hopper 1. A supply port 3 as an example of an inflow port is formed at the front end part of the lower part 1*a* of the toner hopper 1. The supply port 3 allows a developer to flow to the supply section 2 from the lower part 1*a* of the toner hopper 1.

In addition, a recovery section 4 is supported on the lower left side of the lower part 1*a* of the toner hopper 1.

A first auger 6 as an example of a developer transport member is disposed in the lower part 1*a* of the toner hopper 1. The first auger 6 extends in the forward-backward direction along the lower part 1*a*. The first auger 6 transports the developer in the lower part 1*a* toward the supply port 3 at the time of rotation.

A developing roll 7 as an example of a developer holding member is disposed on the lower left side of the supply section 2. The developing roll 7 is disposed to be opposed to the photoreceptor drum PRy in the developing region Q2*y*. In FIG. 2, the developing roll 7 of Exemplary Embodiment 1 is driven to be rotated in the direction of the arrow Yb.

A layer forming roll 8 as an example of an opposing member is supported on the upstream side of the developing region Q2*y* in the rotation direction Yb of the developing roll 7. The layer forming roll 8 is opposed to and brought into contact with the developing roll 7. In addition, the layer forming roll 8 of Exemplary Embodiment 1 is driven to be rotated in the direction of the arrow Yc.

A first scraper 9 as an example of a peeling member is disposed on the downstream side of a region opposed to the layer forming roll 8 and the developing roll 7 in the rotation direction Yc of the layer forming roll 8. The first scraper 9 of Exemplary Embodiment 1 is constituted of a thin plate-shaped member. The first scraper 9 is supported by the right side wall of the supply section 2 at the base end part. The first scraper 9 is disposed to be brought into contact with the layer forming roll 8 at the tip end part.

A refresh roll 11 as an example of a peeling member is supported on the downstream side of the developing region Q2*y* in the rotation direction Yb of the developing roll 7. The refresh roll 11 of Exemplary Embodiment 1 is disposed to be brought into contact with the developing roll 7. In FIG. 2, the refresh roll 11 is driven to be rotated in the direction of the arrow Yd.

A second scraper 12 as an example of a peeling member is disposed on the downstream side of a region opposed to the refresh roll 11 and the developing roll 7 in the rotation direction Yd of the refresh roll 11.

The second scraper 12 of Exemplary Embodiment 1 is constituted of a thin plate-shaped member. The second scraper 12 is supported in the recovery section 4 at the base end part. The second scraper 12 is disposed to be brought into contact with the refresh roll 11 at the tip end part.

Figure 3:
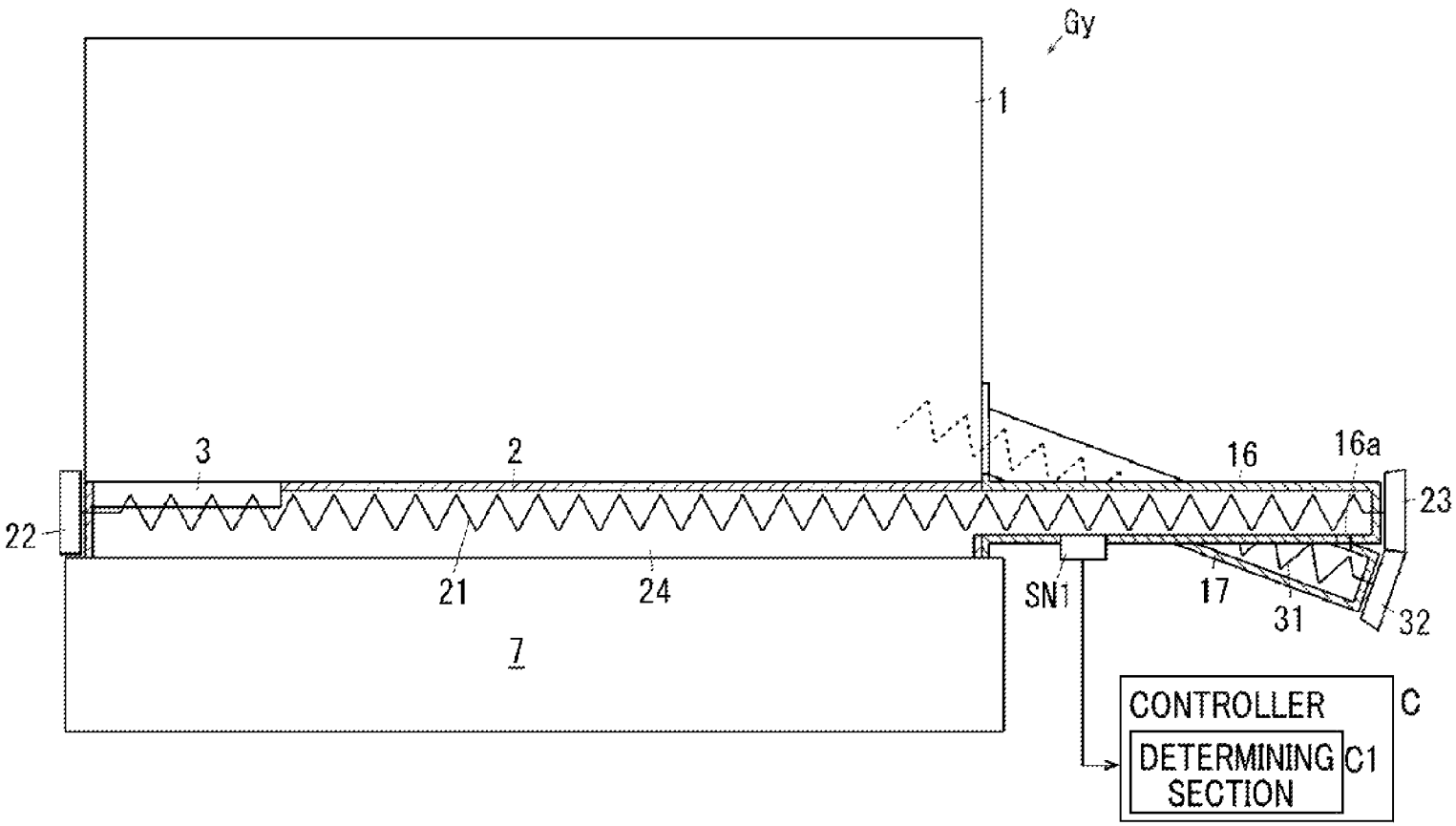
FIG. 3 is a cross-sectional view, taken along line III-III of FIG. 2.

FIG. 3 is a cross-sectional view, taken along line III-III of FIG. 2.

In FIG. 3, a first pipe section 16 as an example of a developer transport section is supported at the rear end of the supply section 2. The first pipe section 16 of Exemplary Embodiment 1 is formed to have a cylindrical shape extending backward from the rear end of the supply section 2. An outflow port 16*a* as an example of an opening is formed in a bottom part of the rear end of the first pipe section 16.

A second pipe section 17 as an example of a developer transport section is disposed below the outflow port 16*a* of the first pipe section 16. The second pipe section 17 is formed to have a cylindrical shape. The second pipe section 17 of Exemplary Embodiment 1 is supported by the rear surface of the lower part of the toner hopper 1 at the front end. The second pipe section 17 is connected to the outflow port 16*a* at the rear end. Accordingly, the second pipe section 17 of Exemplary Embodiment 1 extends obliquely upward and obliquely forward on the left from the outflow port 16*a* to connect the outflow port 16*a* to the toner hopper 1.

In FIGS. 2 and 3, a first agitator 21 as an example of a developer transport member is disposed in the supply section 2 and the first pipe section 16. The first agitator 21 of Exemplary Embodiment 1 is formed to have a so-called coil spring shape in which a wire is wound in a spiral manner. The front end part of the first agitator 21 is rotatably supported by a wall surface at the front end of the supply section 2. A gear 22 as an example of a gear is supported at the front end of the first agitator 21. A driving force is transmitted to the gear 22 as in the cases of the first auger 6, the developing roll 7, the layer forming roll 8, the refresh roll 11 and the like. The rear end part of the first agitator 21 is rotatably supported by a wall surface at the rear end of the first pipe section 16. A bevel gear 23 as an example of a gear is supported at the rear end of the first agitator 21.

The agitator 21 of Exemplary Embodiment 1 is disposed to be separated from the developing roll 7 with a predetermined interval therebetween. Accordingly, in Exemplary Embodiment 1, a space 24 in which a developer is stored is formed between the developing roll 7, the first agitator 21, and the layer forming roll 8.

Accordingly, when the first agitator 21 is rotated, the developer at a height equal to or greater than the height of the first agitator 21 in the space 24 is transported toward the outflow port 16*a* from the supply port 3 by the first agitator 21.

In FIG. 3, a second agitator 31 as an example of a second developer transport member is disposed in the second pipe section 17. The second agitator 31 is formed to have a coil spring shaped as in the case of the first agitator 21. The front end of the second agitator 31 extends up to the inside of the toner hopper 1. The rear end part of the second agitator 31 is rotatably supported by a wall surface at the rear end of the second pipe section 17. A bevel gear 32 as an example of a gear which engages with the bevel gear 23 is supported at the rear end of the second agitator 31. Accordingly, when the first agitator 21 is rotated, the rotation is transmitted through the bevel gears 23 and 32 and the second agitator 31 is thus rotated. While being rotated, the second agitator 31 transports the developer flowing to the second pipe section 17 from the outflow port 16*a* toward the toner hopper 1.

Although omitted in the figure, the recovery section 4 also has a configuration in which the developer which is peeled off from the refresh roll 11 by the second scraper 12 is returned to the toner hopper 1 as in the cases of the pipe sections 16 and 17 and the agitators 21 and 31.

In FIG. 3, a sensor SN1 as an example of a detecting member is supported by the first pipe 16. The sensor SN1 detects the presence or absence of the developer transported to the outside of a region A1. The detecting signal of the sensor SN1 is output to the controller C.

The controller C of the printer U of Exemplary Embodiment 1 is constituted of a microcomputer as an example of a calculator. The controller C has a so-called I/O which is an input/output interface as an example of an input/output signal adjustment section which adjusts signal input and output from/to the outside and adjusts input/output signal levels. In addition, the controller C has a so-called ROM which is a read-only memory as an example of a storing device which stores programs for executing the processes, data and the like. In addition, the controller C has a hard disk drive as an example of a storing device which stores programs for executing the processes, data and the like. In addition, the controller C has a so-called RAM which is a random access memory as an example of a storing device for temporarily storing programs for executing the necessary processes, necessary data and the like. In addition, the controller C has a so-called CPU which is a computing device which performs processes according to the programs stored in the ROM, HDD, and RAM. In addition, the controller C has a clock oscillator as an example of a transmitter. The controller C is capable of realizing various functions by executing the programs stored in the ROM and the like.

The controller C of Exemplary Embodiment 1 has a determining section C1. The determining section C1 determines that the developer in the toner hopper 1 is exhausted when the sensor SN1 detects no developer.

The developing devices Gy to Gk of Exemplary Embodiment 1 are supported detachably from the printer U. Accordingly, the developing devices Gy to Gk are replaceable when the developer in the toner hoppers 1 of the developing devices Gy to Gk is exhausted or the developing devices Gy to Gk are broken.

Description of Action of Developing Device of Exemplary Embodiment 1

In the developing devices Gy to Gk of the printer U of Exemplary Embodiment 1 which have the above-described configuration, the developing roll 7, the first auger 6, the layer forming roll 8, the refresh roll 11, and the agitators 21 and 31 are rotated during execution of jobs.

The developer in the lower part 1*a* of the toner hopper 1 is transported toward the supply port 3 on the front side with the rotation of the first auger 6. The developer transported to the supply port 3 flows out toward the supply section 2 from the lower part 1*a*. The developer in the supply section 2 is freely fallen and supplied to the surface of the developing roll 7. The developer on the surface of the developing roll 7 is transported between the developing roll 7 and the layer forming roll 8 with the rotation of the developing roll 7. The developer transported between the developing roll 7 and the layer forming roll 8 is subjected to frictional charging with the frictional contact between the developing roll 7 and the layer forming roll 8. The developer subjected to the frictional charging is electrostatically sucked to the surface of the developing roll 7. In addition, when the developer passes between the developing roll 7 and the layer forming roll 8, the developer is regulated by the layer forming roll 8, and thus the developer subjected to the frictional charging forms a thin layer on the surface of the developing roll 7.

The developer on the surface of the developing roll 7 develops latent images on the surfaces of the photoreceptor drums PRy to PRK as visible images in the developing regions Q2*y* to Q2*k*. The developer remaining on the surface of the developing roll 7 passing through the developing regions Q2*y* to Q2*k* is moved to the refresh roll 11 with the contact with the rotating refresh roll 11. The developer adhered to the surface of the refresh roll 11 is peeled off by the second scraper 12 and recovered by the recovery section 4. The developer in the recovery section 4 is returned to the toner hopper 1 by virtue of the configuration returning to the toner hopper 1 (not shown). Accordingly, the developer returned to the toner hopper 1 is re-used.

The developer which is regulated by the layer forming roll 8 and is thus not adhered to the developing roll 7 is stored in the space 24. In addition, the developer adhered to the surface of the layer forming roll 8 is also peeled off from the surface of the layer forming roll 8 by the first scraper 9 with the rotation of the layer forming roll 8. Accordingly, the developer is stored in the space 24. Furthermore, in the developing devices Gy to Gk of Exemplary Embodiment 1, the developer supplied to the developing roll 7 is supplied by free fall from the supply section 2 on the upper side.

The developer at the height equal to or greater than the height of the first agitator 21 in the space 24 is transported toward the rear side which is the outside of the region A1 opposed to the developing roll 7. The developer which is transported backward by the first agitator 21 is returned to the toner hopper 1 through the second agitator 31 and re-used.

When a supply roll is used as in the related configurations, the developer adhered to the supply roll is supplied to the developing roll 7. Accordingly, the developer supplied to the developing roll 7 is controllable by the supply roll. That is, in the configuration having the supply roll, it is not easy that the developer is excessively supplied to the developing roll 7. However, a material such as a sponge is used for the supply roll to hold an uncharged developer on the surface, and there is a problem in that the supply roll is easily worn. That is, the supply roll has a short lifespan. Accordingly, the total lifespan of the developing device G is influenced by the lifespan of the supply roll.

In addition, when the supply amount of the developer is controlled by the supply roll as in the related configurations, the developer supplied from the toner hopper is needed to be supplied to the supply roll, not directly to the developing roll. When the supply roll is disposed above the developing roll, there is concern that the developer may flow to the developing roll without passing through the supply roll. Accordingly, in order that the supply roll transports a developer while controlling the amount toward the developing roll, the supply roll is needed to be disposed on the side of or below the developing roll. Therefore, it is necessary that the toner hopper is positioned to be able to supply a developer to the supply roll on the side of or below the developing roll. Accordingly, the toner hopper has a shape swollen toward the right side of the developing roll, that is, toward the farther side from the photoreceptor as in the related configurations, and thus there is a problem in that the size of the developing device in the leftward-rightward direction is increased.

On the other hand, in the developing devices Gy to Gk of Exemplary Embodiment 1, the developer is supplied to the developing roll 7 by free fall without using the supply roll, and it is possible to increase the total lifespan of the developing devices Gy to Gk. At this time, there is concern that the developer may be excessively supplied by free fall and the pressure of the developer in the space 24 may be excessively increased. However, in the developing devices Gy to Gk of Exemplary Embodiment 1, the first agitator 21 transports a developer at a height equal to or greater than the height of the first agitator 21, that is, an extra developer. Accordingly, the developer in the space 24 is suppressed from being excessively increased.

In addition, in the developing devices Gy to Gk of Exemplary Embodiment 1, the developer is supplied to the developing roll 7 by free fall without using the supply roll, and it is possible to position the toner hopper 1 to be disposed above the photoreceptor drums PRy to PRk. Accordingly, this contributes to reducing the sizes of the developing devices Gy to Gk and the total size of the printer U in the leftward-rightward direction. Particularly, in the printer U of Exemplary Embodiment I in which the four developing devices Gy to Gk are arranged in the leftward-rightward direction, when each of the developing devices Gy to Gk is reduced in size, a remarkable size reduction effect is easily shown as a whole.

In addition, in the developing devices Gy to Gk of Exemplary Embodiment 1, whether or not the toner hopper 1 is empty is determined on the basis of the detection result of the sensor SN1 disposed in the first pipe 16. That is, when the developer in the toner hopper 1 is exhausted and the space 24 has no extra developer, the sensor SN1 detects no developer. Accordingly, it is detected that the toner hopper 1 is empty. Even when it is detected that the toner hopper 1 is empty, it is possible to continue the printing to some extent with a developer stored in the space 24. Accordingly, even after it is detected that the toner hopper 1 is empty, the user interface U0 is allowed to perform a display operation to prompt a user to provide new developing devices Gy to Gk, and it is also possible not to stop the printer U until the printing is performed on a predetermined number of sheets, for example, 100 sheets.

Furthermore, in the developing devices Gy to Gk of Exemplary Embodiment 1, the developer transported by the first agitator 21 and the developer recovered by the recovery section 4 are returned to the toner hopper 1 and re-used. Accordingly, waste is reduced as compared to a case in which the developer is not re-used.

Exemplary Embodiment 2

Figure 4:
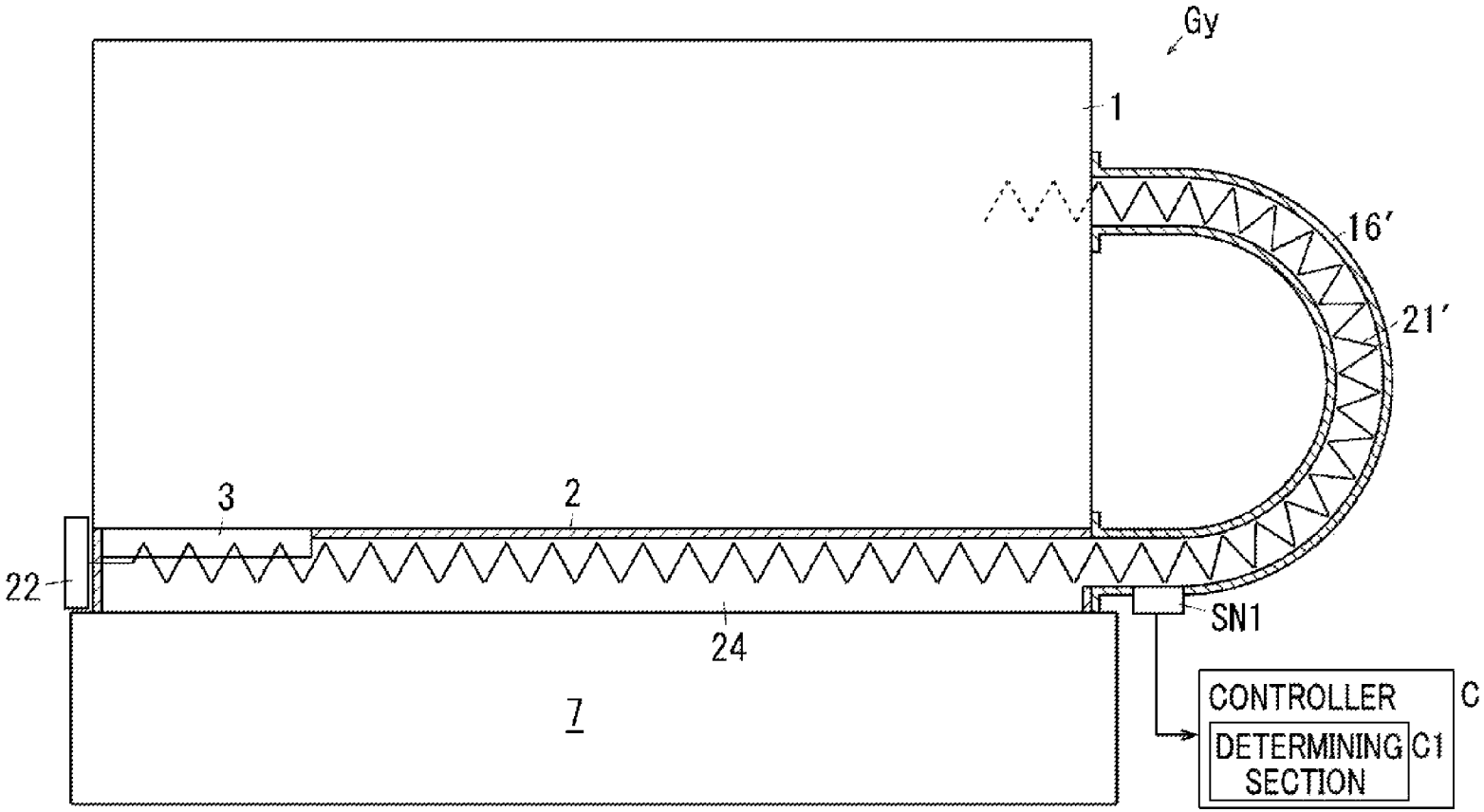
FIG. 4 is a diagram illustrating a developing device of Exemplary Embodiment 2 and corresponding to FIG. 3 of Exemplary Embodiment 1.

FIG. 4 is a diagram illustrating a developing device of Exemplary Embodiment 2 and corresponding to FIG. 3 of Exemplary Embodiment 1.

In the description of Exemplary Embodiment 2, constituent elements corresponding to the constituent elements of the above-described Exemplary Embodiment 1 will be denoted by the same reference symbols, and detailed descriptions thereof will be omitted.

Exemplary Embodiment 2 is different from the above-described Exemplary Embodiment 1 in terms of the following points, but regarding other points, it is configured in the same manner as in the above-described Exemplary Embodiment 1.

In FIG. 4, a developing device Gy of Exemplary Embodiment 2 has a pipe section 16' as an example of a developer transport section curved into a semicircular arc shape, in place of the first pipe section 16 and the second pipe section 17 obliquely intersecting with each other which have been described in Exemplary Embodiment 1.

In addition, in Exemplary Embodiment 2, in place of the first agitator 21 and the second agitator 31 of Exemplary Embodiment 1, an agitator 21' as an example of a developer transport member is accommodated in the pipe section 16'.

Action of Developing Device of Exemplary Embodiment 2

In the developing device Gy of Exemplary Embodiment 2 having the above-described configuration, the extra developer in a space 24 is returned to a toner hopper 1 using one agitator 21'. Accordingly, it is possible to reduce the number of components as compared to Exemplary Embodiment 1.

As in Exemplary Embodiment 1, it is also possible to increase the lifespan of the developing device Gy of Exemplary Embodiment 2, reduce the size of the developing device Gy, and detect that the developing device Gy is empty.

MODIFIED EXAMPLES

Although the exemplary embodiments of the invention have been described in detail, the invention is not limited to the above-described exemplary embodiments, and various modifications may be made in the range of the gist of the invention described in the claims. Modified examples H01 to H07 of the invention will be exemplified as follows.

(H01) In the above-described exemplary embodiments, although the printer U is exemplified as an example of an image forming apparatus, the invention is not limited thereto. For example, the invention may be applied to copiers, FAXes, or multi-function machines having the plural functions. In addition, the invention is not limited to the multiple color image forming apparatus and is also applicable to a monochrome image forming apparatus. Furthermore, the invention is not limited to the configuration using the transfer belt B which holds a sheet S on a surface thereof and is also applicable to a configuration using an intermediate transfer belt. In addition, the invention is also applicable to an image forming apparatus for 3 or less colors or 5 or more colors.

(H02) In the above-described exemplary embodiments, although the supply port 3 is provided at the front end part, the invention is not limited thereto. For example, it may be formed at an arbitrary position in the forward-backward direction. In addition, it may also be a supply port having a width extending to the whole region in the forward-backward direction.

(H03) In the above-described exemplary embodiments, although it is desirable that the position at which the sensor SN1 is provided is provided on the downstream side as closely as possible to the region A1, the invention is not limited thereto. For example, the position may be changed to an arbitrary position so as to be provided in the vicinity of the connecting part of the toner hopper 1 or in the second pipe 17. In addition, a configuration is also employable in which the sensor SN1 and the determining section C1 are not provided when another method is used to detect that the toner hopper 1 is empty.

(H04) In the above-described exemplary embodiments, the first agitator 21 is not limited to the configuration having a coil spring shape. For example, a configuration employing a rotation shaft and a blade may also be employed as in the case of the first auger 6.

(H05) In the above-described exemplary embodiments, although it is desirable to employ the configuration in which the developer recovered by the first agitator 21 and the recovery section 4 is returned to the toner hopper 1 and re-used, the invention is not limited thereto. For example, a configuration is also employable in which the developer is transported to a container for disposal.

(H06) In the above-described exemplary embodiments, the configuration has been exemplified in which the toner hopper 1 is replaceable integrally with the developing roll 7, but the invention is not limited thereto. For example, a configuration is also applicable in which only the toner hopper 1 is replaceable and the developing roll 7 is continuously mounted on the printer U until the lifespan is completed. When the invention has this configuration, the developing roll 7 is not included as a replacement component and it is expected that the replacement component cost will be reduced.

(H07) In the above-described exemplary embodiments, the invention is not limited to the single-component developer and is also applicable to a two-component developer including a toner and a carrier.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer holding member that holds a developer on a surface thereof to transport the developer to a developing region in which a latent image is developed as a visible image;

an accommodating section that accommodates the developer supplied to the developer holding member;

a supply section that is connected to the accommodating section and disposed above the developer holding member in the direction of gravity to supply the developer to the developer holding member from above;

a first transport member that is disposed in the supply section to transport the developer and transports the developer in the developer accommodated in the supply section to an outside of a region corresponding to the developer holding member; and a detecting member that detects the developer that is transported to the outside of the region corresponding to the developer holding member by the first transport member.

2. The developing device according to claim 1, further comprising:

a second transport member that is disposed on the downstream side of the first transport member in a developer transport direction to transport the developer transported by the first transport member toward the accommodating section.

3. The developing device according to claim 2, further comprising:

a determining section that determines that the developer in the accommodating section is exhausted when the detecting member detects no developer.

4. An image forming apparatus comprising:

an image holding member of which surface a latent image is formed on;

the developing device according to claim 2 that develops the latent image on the surface of the image holding member as a visible image;

a transfer device that transfers the visible image on the surface of the image holding member onto a medium; and a fixing device that fixes the visible image on a surface of the medium.

5. The developing device according to claim 2, further comprising:

an outflow port formed in a bottom part of an end portion of the first transport member, the second transport member being connected to the outflow port.

6. The developing device according to claim 1, further comprising:

a determining section that determines that the developer in the accommodating section is exhausted when the detecting member detects no developer.

7. An image forming apparatus comprising:

an image holding member of which surface a latent image is formed on;

the developing device according to claim 1 that develops the latent image on the surface of the image holding member as a visible image;

a transfer device that transfers the visible image on the surface of the image holding member onto a medium; and a fixing device that fixes the visible image on a surface of the medium.

8. A developing device comprising:

a developer holding member that holds a developer on a surface thereof to transport the developer to a developing region in which a latent image is developed as a visible image;

an accommodating section that accommodates the developer supplied to the developer holding member;

a supply section that is connected to the accommodating section and disposed above the developer holding member in the direction of gravity to supply the developer to the developer holding member from above;

a first transport member that is disposed in the supply section to transport the developer and transports the developer in the developer accommodated in the supply section to a developer transport section that connects the accommodating section and the supply section outside of a region corresponding to the developer holding member; and a detecting member disposed in the developer transport section that detects the developer in the developer transport section.

* * * * *